US006880178B2

(12) United States Patent
Pino

(10) Patent No.: US 6,880,178 B2
(45) Date of Patent: Apr. 19, 2005

(54) LINE GUARD WITH VISIBLE INDICATOR

(76) Inventor: W. J. Sonny Pino, 12233 Chocktaw Dr., Baton Rouge, LA (US) 70815

( * ) Notice: Subject to any disclaimer, the term of this patent is extended or adjusted under 35 U.S.C. 154(b) by 0 days.

(21) Appl. No.: 10/643,024

(22) Filed: Aug. 18, 2003

(65) Prior Publication Data

US 2005/0039247 A1 Feb. 24, 2005

(51) Int. Cl.[7] ..... E03D 9/00

(52) U.S. Cl. ..... 4/255.01; 4/256.1; 294/86.4; 15/104.32

(58) Field of Search ..... 4/255.01, 256.1; 294/86.1, 86.4; 15/104.32; 166/99

(56) References Cited

U.S. PATENT DOCUMENTS 1,356,841 A * 10/1920 Utley ..... 15/104.32 X
4,932,080 A 6/1990 Pino
4,996,725 A 3/1991 Pino
5,027,447 A 7/1991 Pino
5,251,339 A * 10/1993 Piskula ..... 4/255.01
5,638,557 A * 6/1997 Iida et al. ..... 4/679

* cited by examiner

*Primary Examiner*—Robert M. Fetsuga
(74) *Attorney, Agent, or Firm*—Roy, Kiesel, et al; Neil J. Coig

(57) ABSTRACT

The invention is drawn to a retractable guard for use in a sewerage or drainage line having a plurality of prongs with hooked ends are disposed within a sewage pipe downstream of a toilet. The opposite ends of the prongs are connected to a tubular member which, in turn is slidable within a housing connected to the pipe. These prongs can be used to trap articles which can then be easily removed to rectify stoppage problems or prevent contraband from being distributed through the drainage lines. For convenience in cleaning, the guard device can also be provided with a quick-release connection which separates from the pipe with a simple twist. The prongs can also be magnetized to trap metal objects. The prongs may also be mounted on a pivoting shaft to enable mounting within an angled pipe. For convenience in inspection, the guard device can be provided with a clear portion to enable visual inspection of the interior of the guard device.

14 Claims, 2 Drawing Sheets

LINE GUARD WITH VISIBLE INDICATOR

BACKGROUND OF THE INVENTION

1. Field of the Invention

This invention relates generally to a device placed in a sewer pipe to trap certain articles which may plug the pipe. In particular, this invention relates to a guard with self-cleaning features having special applications for toilets in prisons and other correctional or industrial facilities.

2. Prior Art

The desirability of providing a guard in a drain pipe or sewer pipe to trap articles which would otherwise clog the pipe has long been recognized in the prior art. With regard to a sewer pipe leading from a toilet, the requirement of a guard is that the ordinary solids introduced into a toilet, such as excrement and tissue paper, should be allowed to pass unobstructed, while articles not readily decomposed, such as cloth, diapers, sanitary napkins and plastic, should be trapped. The aforementioned requirements are particularly stringent in the prison setting. Prisoners are prone to introduce cloth and paper into the toilets with the intent that the prison sewage discharge lines become clogged and the sewage water back up so as to overflow into the prisoners' cells. With an ordinary sewage system it is not possible in many cases to determine which prisoner caused the sewage line to become clogged. Thus it is not always possible to punish the prisoner thereby deterring similar future episodes.

Especially damaging is cloth or other material which, even if it does not clog the pipes, is not broken down and passes to the treatment plant where the material can not be digested or properly handled, which can cause such treatment plant to be shut down.

Another problem particular to the prison setting is the need to prevent various metal objects from being flushed through the prison sewage system. In many instances these metal objects will be homemade knives and other weapons that the prisoner is trying to dispose of in order to avoid being caught in possession of these prohibited devices.

Yet another problem with the current art is that it cannot be inserted into pipes with curves or angles, limiting implementations to those applications with only straight pipes.

Still another problem is that the device must be opened in order to inspect the contents of each line. This can often be a tedious, time-consuming, and potentially messy process.

Various stationary devices have been employed in sewer lines to trap undesirable articles. Several of these inventions disclose devices with hooks which are positioned in the sewer line. However, because these devices are stationary, there is a tendency for otherwise safe waste, especially toilet paper, to accumulate on the hooks. Eventually, the line plugs at the site of the guard device.

Devices which rotate within a pipe to scrape the interior of the pipe or pulverize solids have been employed with some success. In a prison setting, however, where material and garments are introduced into the sewage system, additional burdens are placed upon the comminuting devices. For example, even the most powerful in-line device disclosed in the prior art would have difficulty pulverizing a bed sheet. In addition they would not be able to prevent the passage of certain metal objects that are commonly made by prisoners and used as weapons. However, most importantly, these devices are used after the incident has occurred in order to clear a line, which, without the current device, may occur at any number of places in the sewer or drainage system. The current device permits the stoppage to be planned for, by placing the invention where the stoppage can be best dealt with, generally, before if affects other areas of the facility, or worse still, other portions of the system or processing facility.

Further, none of the current art provides a way to inspect the contents of the line without opening the line, nor do they permit the installation of the line guard in a pipe that is curved or angled.

OBJECTS OF THE INVENTION

One object of this invention is to provide a guard which will catch undesirable articles introduced into a sewer pipe without causing the pipe to become clogged.

Another object of this invention is to provide a guard which catches certain metal articles near the point of their introduction to prevent disruption of the entire sewage system.

Another object of this invention is to provide a guard with self-leaning features.

Another object of this invention is to provide a guard that will prevent prisoners from passing contraband between prisoner's cells through the use of the sewage line.

Another object of this invention is to provide a guard that will be mountable in an angled or curved connection of pipe.

Yet another object of this invention is to provide a guard that enables a user to see within the guard to determine if blockages are present without opening the installed lines.

Other objects and advantages of this invention will be apparent from the ensuing descriptions of this invention.

SUMMARY OF THE INVENTION

The invention is drawn to a retractable guard for use in a sewerage or drainage line having a plurality of prongs with hooked ends are disposed within a sewage pipe downstream of a toilet. The opposite ends of the prongs are connected to a tubular member which, in turn is slidable within a housing connected to the pipe. These prongs can be used to trap articles which can then be easily removed to rectify stoppage problems or prevent contraband from being distributed through the drainage lines. For convenience in cleaning, the guard device can also be provided with a quick-release connection which separates from the pipe with a simple twist. The prongs can also be magnetized to trap metal objects. The prongs may also be mounted on a pivoting shaft to enable mounting within an angled pipe. For convenience in inspection, the guard device can be provided with a clear portion to enable visual inspection of the interior of the guard device.

BRIEF DESCRIPTION OF THE DRAWINGS

The accompanying drawings illustrate an embodiment of this invention. However, it is to be understood that this embodiment is intended to be neither exhaustive, nor limiting of the invention. They are but examples of some of the forms in which the invention may be practiced.

DETAILED DESCRIPTION OF EXEMPLARY EMBODIMENTS

Figure 1:
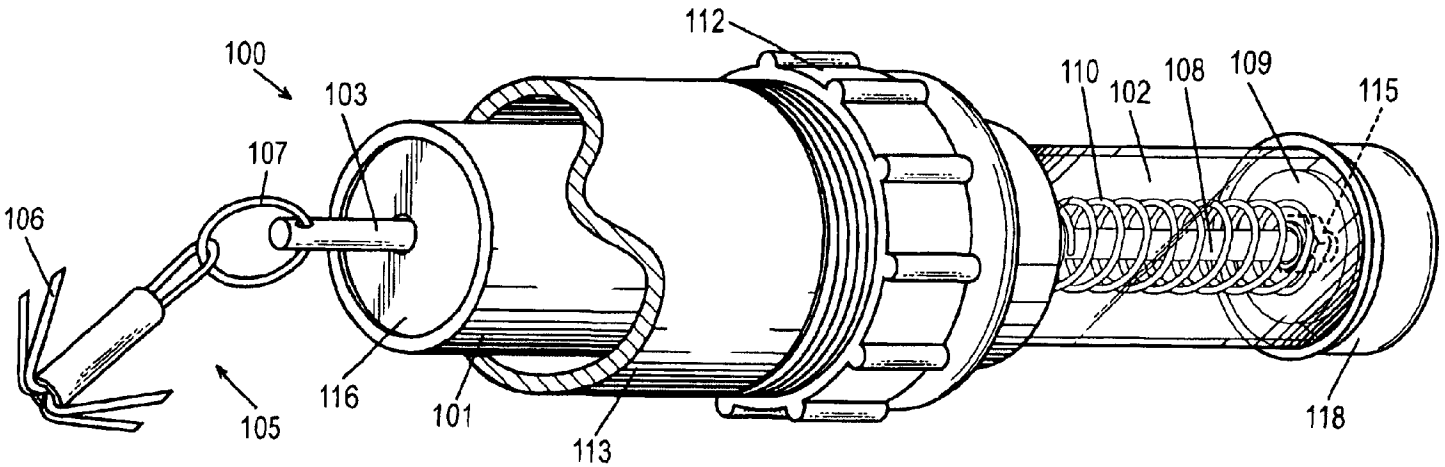
FIG. 1 is a perspective view of the guard.
Figure 2:
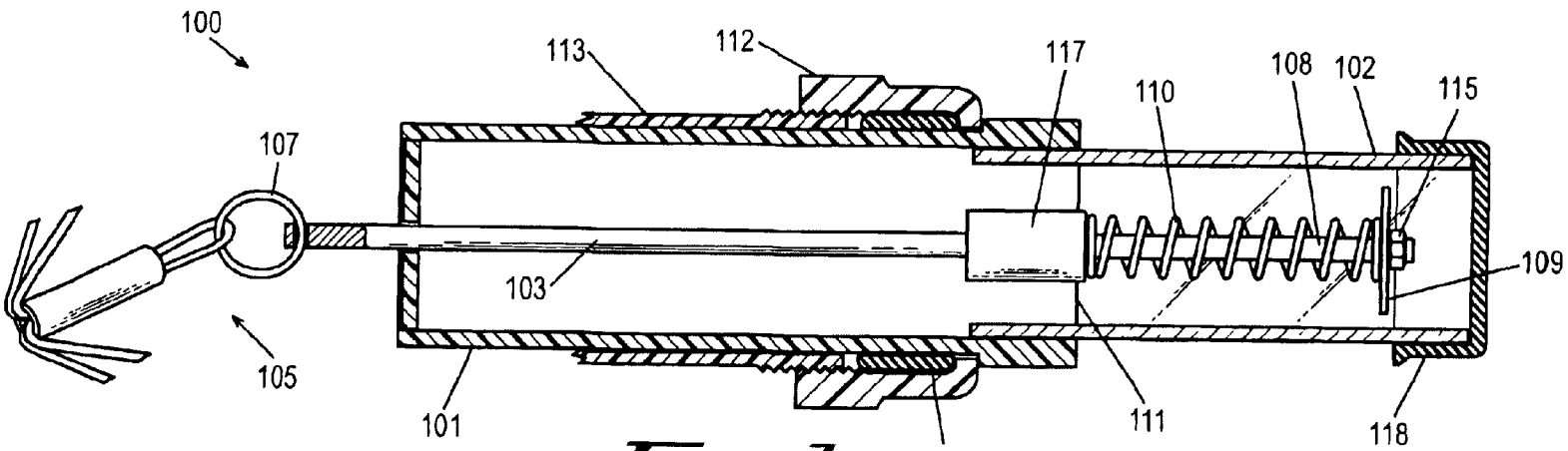
FIG. 2 is a side cross-sectional view of the guard.
Figure 3:
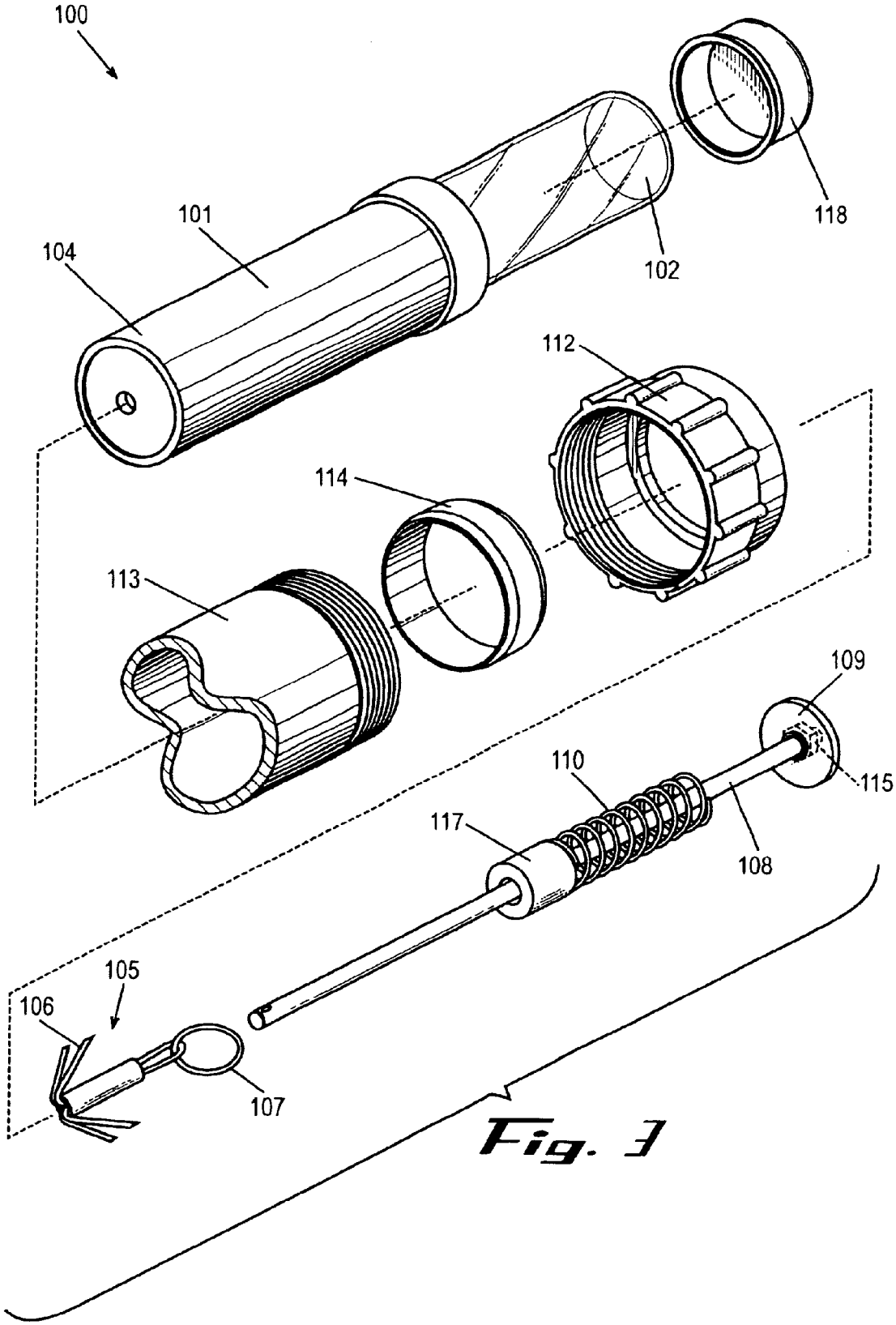
FIG. 3 is an exploded view of the guard.

Without any intent to limit the scope of this invention, reference is made to the figures in describing the various embodiments of the invention. Referring to FIGS. 1 through 3, line guard is pictured.

Apparatus 100 is pictured with housing 101 that can be either entirely, or in the embodiment shown, partially, made of a transparent or clear section 102 that permits the inspection of the components that lie within the clear section 102. This housing 101 can be made of any material, such as PVC, metal or other known materials in the industry. One of the components in the housing 101 is tubular member 103, which extends throughout a substantial part of housing 101 and a portion of which exits the housing on lower side 104 of housing 101.

At the portion of tubular member 103 which exits lower side 104 of housing 101 is attached a hook assembly 105 which comprises at least one prong 106 for retaining articles as described further below, as well as attaching unit 107 which is used to attach hook assembly 105 to said tubular member 103. In the FIGS., four prongs are used, but more or less may be employed. These can be formed in any number of ways, such as folding roughly evenly wires and sharpening the ends to form prongs 106. At least two of prongs 106 could be magnetized so as to attach metal objects that pass through them. If more than three prongs 106 are used, then the adjacent prongs should be oppositely charged. Similarly, at least a portion of tubular member 103 can be magnetized. This may be achieved by attaching magnets to tubular member 103 so that the opposite ends of the magnets will be oppositely charged.

On upper section 108 of tubular member 103 is attached upper stop 109 which is used to retain kinetic energy store 110, which can be a spring, Belleville stack, or the like, along with lower stop 111. This creates the zone where kinetic energy is imparted on tubular member 103. Upper stop 109 can be secured on tubular member 103 by various means, one of which is as pictured in the FIGS., or that of a threaded nut 115 which prevents upper stop 109 from detaching from tubular member 103.

Other components which are typically used in the installation are removable connection 112 which is used to connect apparatus 100 to sewer pipe 113. In conjunction with this connection, sealing member 114 which is placed between removable connection 112 and sewer pipe 113 in order to prevent leaks.

Additionally, cap 118 may be employed to seal off end, or, housing 101 could be cast in a single piece. The advantage to utilizing cap 118 is that tubular member 103 can be easily removed and serviced from the open end of housing 101 by removing cap 118.

A lower guide 116 can also be employed in order to guide tubular member 103 as it exits apparatus 100. Additionally, spacer 117 can be employed to keep upper stop 109 and kinetic energy store 110 in plain view of clear section 102 of housing 101, for purposes of inspection, as explained further below.

In operation, apparatus 100 is placed with lower end extending into sewer or other drainage line or sewer pipe 113 sought to be protected from undesirable articles. In this manner, undesirable articles introduced into sewer pipe 113 are caught by prong(s) 106 at the end of hook assembly 105. In this manner, the undesirable articles caught by hook assembly 105 exert weight upon hook assembly 105, and in turn, tubular member 103. This moves all components attached to tubular member 103 in a downward direction, which is visible by a quick inspection of clear section 102 of housing 101. By this inspection, a determination can be easily made as to the status of a particular section of sewage or drainage pipe 113 as being clogged or otherwise obstructed. This is possible because in the clear or unobstructed state, tubular assembly will be urged to the upper section of housing 101 by kinetic energy store 110.

Hook assembly 105 has a self-cleaning feature, and that is achieved by the free movement of hook assembly 105, which, when coupled with the drainage fluid moving past hook assembly 105, material intended to be discarded via sewer pipe 113 is rinsed clean from prong(s) 106.

It should be noted that the while the presented embodiment of the invention includes a clear section to view the contents of the apparatus 100, other methods may be employed, such as extending tubular member 103 out of the top, or otherwise providing an indicator that there is a weight present on the hook assembly 105.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention claimed is:

1. An apparatus to catch selected articles introduced into a sewer pipe, comprising:

a. a cylindrical housing having a portion of said housing being comprised of a substantially clear material such that the interior of said housing can be visibly inspected;

b. a tubular member mounted within and parallel to said housing having an upper and lower section, said upper section being mounted in said clear section of said housing;

c. a hook assembly operatively attached to said lower section of said tubular member;

d. an upper stop operatively attached and substantially perpendicular to said upper section of said tubular member;

e. a lower stop operatively attached within and perpendicular to said housing forming a chamber between said upper stop and said lower stop;

f. a kinetic energy store operatively configured around said tubular member and between said upper stop and said lower stop.

2. An apparatus according to claim 1 wherein said hook assembly comprises at least one prong having a pointed end and further comprising an attaching unit by which said hook assembly may be operatively connected to said tubular member thereby permitting the movement of said hook assembly about said tubular member.

3. An apparatus according to claim 2 further comprising a removable connection for attaching said apparatus to said sewer pipe.

4. An apparatus according to claim 3 wherein said removable connection is a threaded connection to said sewer pipe.

5. An apparatus according to claim 4 wherein said hook assembly comprises at least four prongs.

6. An apparatus according to claim 5 further comprising a lower guide configured to position said tubular member within said housing.

7. An apparatus according to claim 6 further comprising a sealing member between said housing and said sewer pipe configured to prevent leakage from said pipe.

8. An apparatus according to claim 7 wherein said kinetic energy store is a spring.

9. An apparatus to catch selected articles introduced into a sewer pipe, comprising:

a. a cylindrical housing having a portion of said housing being comprised of a substantially clear material such that the interior of said housing can be visibly inspected;

b. a tubular member mounted within and parallel to said housing having an upper and lower section, said upper section being mounted in said clear section of said housing;

c. a hook assembly operatively attached to said lower section of said tubular member, said hook assembly having at least one prong having a pointed end and further comprising an attaching unit by which said hook assembly may be operatively connected to said tubular member thereby permitting the movement of said hook assembly about said tubular member;

d. an upper stop operatively attached and substantially perpendicular to said upper section of said tubular member;

e. a lower stop operatively attached within and perpendicular to said housing forming a chamber between said upper stop and said lower stop;

f. a kinetic energy store operatively configured around said tubular member and between said upper stop and said lower stop; and g. a removable connection for attaching said apparatus to said sewer pipe.

10. An apparatus according to claim 9 wherein said removable connection is a threaded connection to said sewer pipe.

11. An apparatus according to claim 10 wherein said hook assembly comprises at least four prongs.

12. An apparatus according to claim 11 further comprising a lower guide configured to position said tubular member within said housing.

13. An apparatus according to claim 12 further comprising a sealing member between said housing and said sewer pipe configured to prevent leakage from said pipe.

14. An apparatus according to claim 13 wherein said kinetic energy store is a spring.

* * * * *